US009334738B2

(12) United States Patent
Nereim et al.

(10) Patent No.: US 9,334,738 B2
(45) Date of Patent: May 10, 2016

(54) GAS TURBINE INCLUDING BELLY BAND SEAL ANTI-ROTATION DEVICE

(71) Applicants: Brian D. Nereim, Winter Springs, FL (US); Rebecca L. Kendall, Oviedo, FL (US); Piyush Sane, Orlando, FL (US)

(72) Inventors: Brian D. Nereim, Winter Springs, FL (US); Rebecca L. Kendall, Oviedo, FL (US); Piyush Sane, Orlando, FL (US)

(73) Assignee: Siemens Aktiengesellschaft, Müchen (DE)

( * ) Notice: Subject to any disclaimer, the term of this patent is extended or adjusted under 35 U.S.C. 154(b) by 729 days.

(21) Appl. No.: 13/657,900

(22) Filed: Oct. 23, 2012

(65) Prior Publication Data

US 2014/0112766 A1 Apr. 24, 2014

(51) Int. Cl.
*F01D 5/06* (2006.01)
*F01D 11/00* (2006.01)

(52) U.S. Cl.
CPC *F01D 5/06* (2013.01); *F01D 11/00* (2013.01); *F01D 11/003* (2013.01); *F01D 11/005* (2013.01)

(58) Field of Classification Search
CPC ..... F01D 5/06; F01D 11/00; F01D 11/003; F01D 11/005; F01D 11/006; F01D 11/008
USPC ..... 277/608, 616, 630, 637
See application file for complete search history.

(56) References Cited

U.S. PATENT DOCUMENTS

| | | | | |
|---|---|---|---|---|
| 5,320,488 | A | 6/1994 | Meade et al. | |
| 5,865,600 | A | 2/1999 | Mori et al. | |
| 5,967,746 | A | 10/1999 | Hagi et al. | |
| 6,089,827 | A | 7/2000 | Ichiryu et al. | |
| 6,315,301 | B1 | 11/2001 | Umemura et al. | |
| 7,470,113 | B2 | 12/2008 | Tran et al. | |
| 7,549,845 | B2 * | 6/2009 | Uwami et al. | 416/198 A |
| 7,581,931 | B2 * | 9/2009 | Shaefer et al. | 416/198 A |
| 2009/0148279 | A1 | 6/2009 | Shaefer et al. | |
| 2009/0191050 | A1 * | 7/2009 | Nereim et al. | 415/173.7 |
| 2010/0074731 | A1 | 3/2010 | Wiebe et al. | |

FOREIGN PATENT DOCUMENTS

| | | | |
|---|---|---|---|
| CN | 102076939 | B | 12/2009 |
| DE | 102006004613 | A1 | 8/2006 |

* cited by examiner

*Primary Examiner* — Craig Kim
*Assistant Examiner* — Brian P Wolcott

(57) ABSTRACT

A sealing band is located in opposing sealing band receiving slots of adjacent turbine disks to seal an annular gap therebetween. A through hole is defined in one of the disks, wherein the through hole defines a longitudinal hole axis and extends to the sealing band receiving slot in the disk. At least one engagement feature is defined on the disk and extends laterally of the through hole, perpendicular to the longitudinal hole axis. A pin member extends through the hole and is positioned within the sealing band receiving slot passing through an opening in the sealing band for resisting movement of the sealing band relative to the disk. The pin member includes a laterally extending cooperating feature positioned in engagement with the engagement feature for retaining the pin within the opening in the sealing band.

19 Claims, 4 Drawing Sheets

GAS TURBINE INCLUDING BELLY BAND SEAL ANTI-ROTATION DEVICE

FIELD OF THE INVENTION

This invention relates in general to seals for multistage turbomachines and, more particularly, to an anti-rotation structure for a seal provided between adjoining disks in a multistage turbomachine.

BACKGROUND OF THE INVENTION

In various multistage turbomachines used for energy conversion, such as turbines, a fluid is used to produce rotational motion. In a gas turbine, for example, a gas is compressed through successive stages in a compressor and mixed with fuel in a combustor. The combination of gas and fuel is then ignited for generating combustion gases that are directed to turbine stages to produce the rotational motion. The turbine stages and compressor stages typically have stationary or non-rotary components, e.g., vane structures, that cooperate with rotatable components, e.g., rotor blades, for compressing and expanding the operational gases.

The rotor blades are typically mounted to disks that are supported for rotation on a rotor shaft. Annular arms extend from opposed portions of adjoining disks to define paired annular arms. A cooling air cavity is formed on an inner side of the paired annular arms between the disks of mutually adjacent stages, and a labyrinth seal may be provided on the inner circumferential surface of the stationary vane structures for cooperating with the annular arms to effect a gas seal between a path for the hot combustion gases and the cooling air cavity. The paired annular arms extending from opposed portions of adjoining disks define opposing end faces located in spaced relation to each other. Typically the opposing end faces may be provided with a slot for receiving a seal strip, known as a "belly band seal", which bridges the gap between the end faces to prevent cooling air flowing through the cooling air cavity from leaking into the path for the hot combustion gases. The seal strip may be formed of plural segments, in the circumferential direction, that are interconnected at lapped or stepped ends.

When the seal strip comprises plural segments positioned adjacent to each other, in the circumferential direction, the seal strips may shift circumferentially relative to each other. Shifting may cause one end of a seal strip segment to increase the overlap with an adjacent segment, while the opposite end of the seal strip segment will move out of engagement with an adjacent segment, opening a gap for passage of gases through the seal strip. Hence, it is typically desirable to provide a mechanism for preventing relative circumferential shifting of the seal strip segments.

SUMMARY OF THE INVENTION

In accordance with an aspect of the invention, a turbine is provided comprising a plurality of stages, each stage comprising a rotatable disk and blades carried thereby, at least one pair of adjacent rotatable disks defining an annular gap therebetween and having respective opposing sealing band receiving slots aligned with the annular gap. A sealing band is located in the opposing sealing band receiving slots to seal the annular gap. A through hole is defined in at least one of the disks, wherein the through hole defines a longitudinal hole axis and extends to the sealing band receiving slot in the at least one disk. At least one engagement feature is defined on the at least one disk and extends laterally of the through hole, perpendicular to the longitudinal hole axis. A pin member extends through the through hole and is positioned within the sealing band receiving slot passing through an opening in the sealing band for resisting movement of the sealing band relative to the at least one disk. The pin member includes a laterally extending cooperating feature positioned in engagement with the engagement feature for retaining the pin within the opening in the sealing band.

The opening in the sealing band may include a notch formed in an edge of the sealing band, and the pin member includes a radially inner end located within the notch in the sealing band.

The cooperating feature may comprise a pair of tabs extending from laterally opposing sides of the inner end of the pin member, and the engagement feature may include a surface within the slot in the at least one disk, extending laterally from the through hole, perpendicular to the longitudinal hole axis, for engagement with the tabs.

The hole may include a pair of opposing laterally extending lobe areas for permitting passage of the tabs therethrough. The pin member may include a radially outer end, opposite the inner end, having outwardly deformed portions extending into the lobe areas for preventing rotation of the pin member within the through hole.

The engagement feature and the cooperating feature may comprise threaded portions on the each of the through hole and the pin member, respectively.

The pin member may include a radially outer end, opposite the inner end, and may include a blind hole extending into the radially outer end.

The through hole may include at least one laterally extending lobe area, and a circumferential wall defining the blind hole in the pin member may define at least one outwardly deformed portion extending into the at least one lobe area for preventing rotation of the pin member within the through hole.

In accordance with another aspect of the invention, a turbine is provided comprising a plurality of stages, each stage comprising a rotatable disk and blades carried thereby, each rotatable disk including a radially outwardly facing side. At least one pair of adjacent rotatable disks define an annular gap therebetween and have respective opposing sealing band receiving slots aligned with the annular gap, the sealing band receiving slots each including opposing outer and inner radially facing slot surfaces. A sealing band is located in the opposing sealing band receiving slots to seal the annular gap. A through hole is defined in at least one of the disks, and extends from the radially outwardly facing side through the outer radially facing slot surface, wherein the through hole defines a longitudinal hole axis and extends to the sealing band receiving slot in the at least one disk. At least one engagement feature on the at least one disk extends laterally of the through hole, perpendicular to the longitudinal hole axis. A pin member extends through the through hole and is positioned through an opening in the sealing band. The pin member includes a radially extending cooperating feature positioned in engagement with the engagement feature for preventing radial movement of the pin member out of the through hole.

The cooperating feature may comprise a pair of tabs extending from laterally opposing sides of the inner end of the pin member, and the engagement feature may include a surface within the slot in the at least one disk, extending laterally from the through hole, perpendicular to the longitudinal hole axis, for engagement with the tabs.

The engagement feature for engaging the pair of tabs may be defined by the outer radially facing slot surface.

The hole may include a pair of opposing laterally extending lobe areas for permitting passage of the tabs therethrough.

The laterally extending lobe areas may comprise generally semi-circular areas extending laterally outwardly from a wall defining the hole.

The pin member may include a radially outer end, opposite the inner end, having outwardly deformed portions extending into the lobe areas for preventing rotation of the pin member within the through hole.

Rotation of the pin member about the longitudinal hole axis may position the cooperating feature into engagement with the engagement feature.

The engagement feature may be defined by a screw thread and the cooperating feature may be defined by a screw thread engaged with the screw thread of the engagement feature.

The pin member may include a radially outer end, opposite the inner end, and may include a blind hole extending into the radially outer end.

The through hole may include at least one laterally extending lobe area, and a circumferential wall defining the blind hole in the pin member may define at least one outwardly deformed portion extending into the at least one lobe area for preventing rotation of the pin member within the through hole.

A slot may be formed in a bottom surface of the blind hole for engagement with a tool to rotate the pin member within the through hole.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
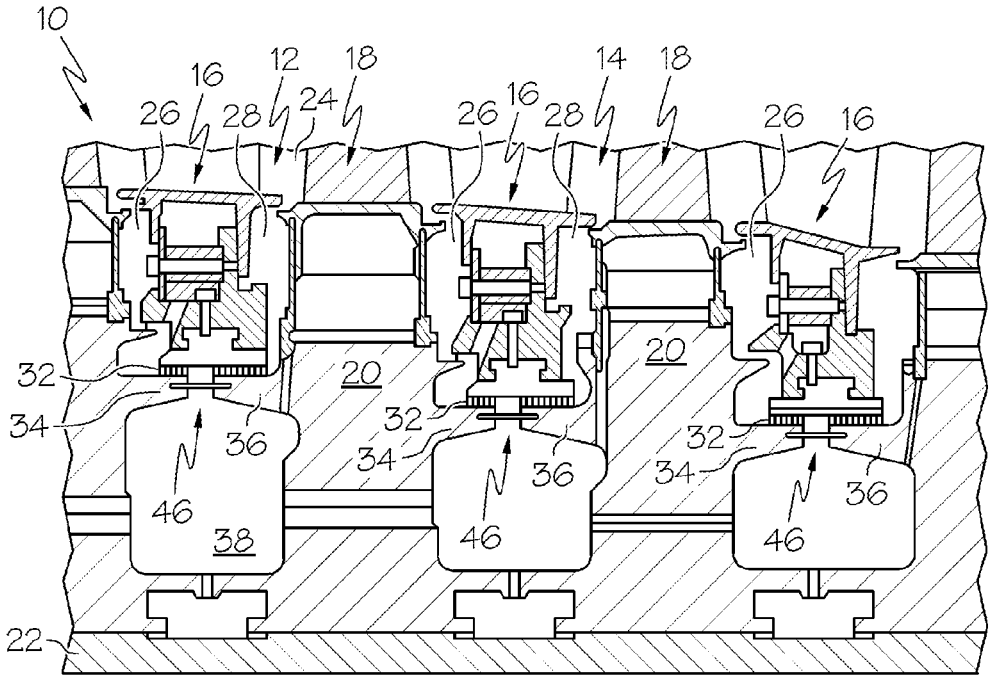
FIG. 1 is a diagrammatic section view of a portion of a gas turbine engine including a seal strip assembly in accordance with the present invention.

Referring to FIG. 1, a portion of a turbine engine 10 is illustrated diagrammatically including adjoining stages 12, 14, each stage 12, 14 comprising an array of stationary vane assemblies 16 and an array of rotating blades 18, where the vane assemblies 16 and blades 18 are positioned circumferentially within the engine 10 with alternating arrays of vane assemblies 16 and blades 18 located in the axial direction of the turbine engine 10. The blades 18 are supported on rotor disks 20 secured to adjacent disks with spindle bolts 22. The vane assemblies 16 and blades 18 extend into an annular gas passage 24, and hot gases directed through the gas passage 24 flow past the vane assemblies 16 and blades 18 to remaining rotating elements.

Disk cavities 26, 28 are located radially inwardly from the gas passage 24. Purge air is preferably provided from cooling gas passing through internal passages in the vane assemblies 16 to the disk cavities 26, 28 to cool the blades 18 and to provide a pressure to balance against the pressure of the hot gases in the gas passage 24. In addition, interstage seals comprising labyrinth seals 32 are supported at the radially inner side of the vane assemblies 16 and are engaged with surfaces defined on paired annular disk arms 34, 36 extending axially from opposed portions of adjoining disks 20. An annular cooling air cavity 38 is formed between the opposed portions of adjoining disks 20 on a radially inner side of the paired annular disk arms 34, 36. The annular cooling air cavity 38 receives cooling air passing through disk passages to cool the disks 20.

Figure 2:
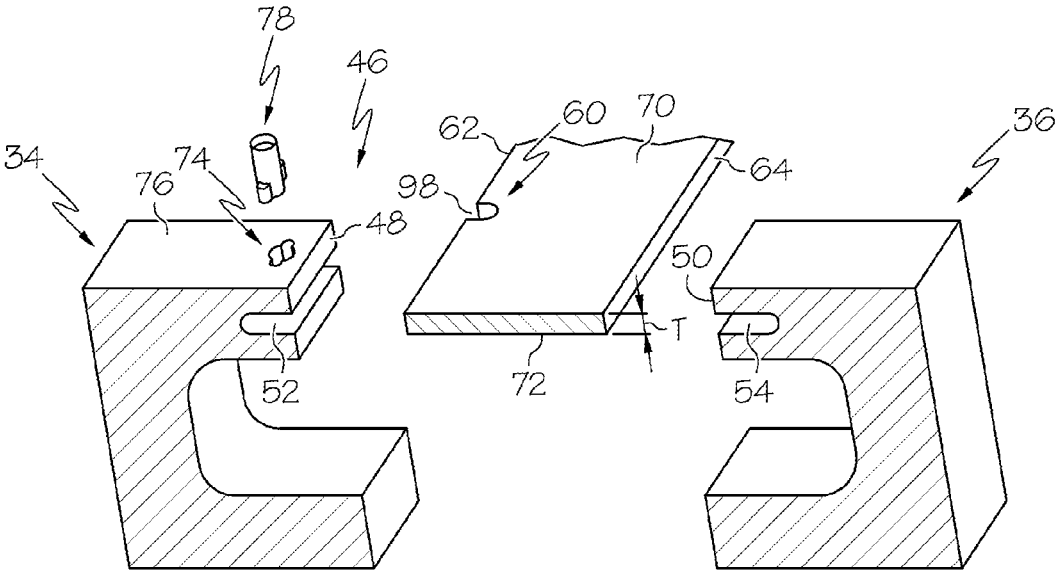
FIG. 2 is an exploded perspective view illustrating the seal strip assembly in accordance with an aspect of the present invention.

Referring further to FIG. 2, the disk arms 34, 36 of two adjoining disks 20 are illustrated for the purpose of describing the seal strip assembly 46 of the present invention, it being understood that the disks 20 and associated disk arms 34, 36 define an annular structure extending the full circumference about the rotor centerline. The disk arms 34, 36 define respective opposed end faces 48, 50 located in closely spaced relation to each other. A circumferentially extending slot 52, 54 is formed in the respective end faces 48, 50, wherein the slots 52, 54 are radially aligned with an annular gap 56 (FIG. 6) defined between the end faces 48, 50.

Figure 6:
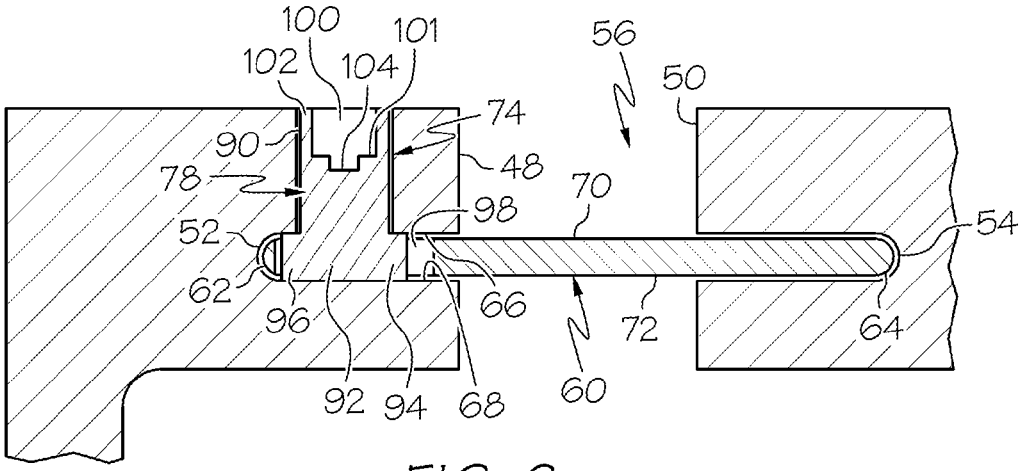
FIG. 6 is a cross-sectional view of the anti-rotation structure in an assembled state, as taken along line 6-6 in FIG. 5.

Referring to FIGS. 2 and 6, the seal strip assembly 46 includes a sealing band 60 forming a circumferentially extending belly band seal. The sealing band 60 includes opposing sealing band edges 62, 64 which are positioned within the respective slots 52, 54 defined in the opposed end faces 48, 50. The sealing band 60 spans the annular gap 56 between the end faces 48, 50 and defines a seal for preventing or substantially limiting flow of gases between the cooling air cavity 38 and the disk cavities 26, 28.

Figure 3:
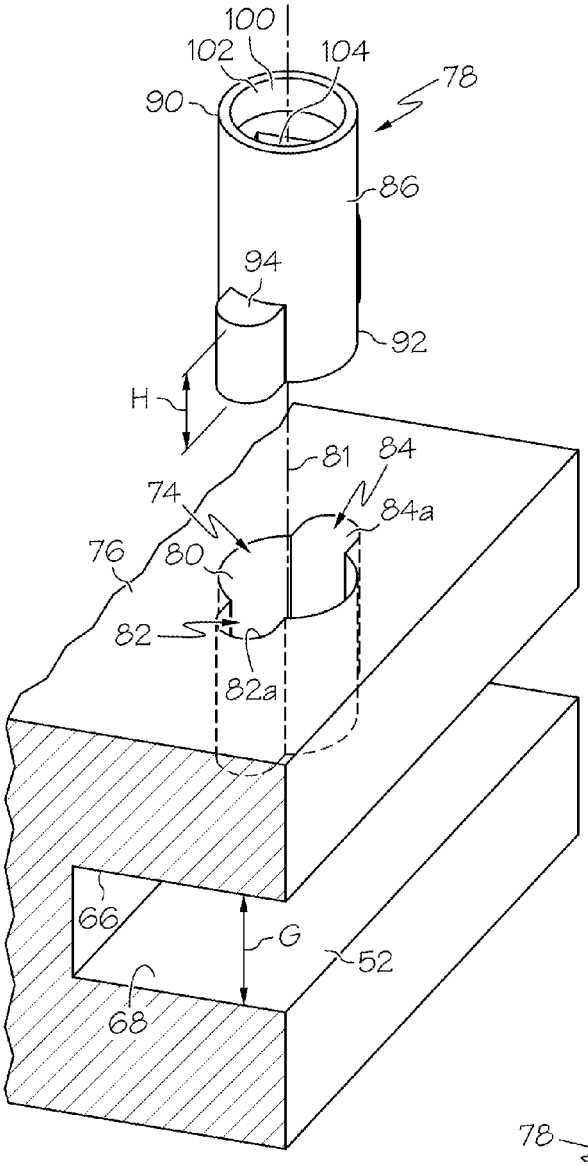
FIG. 3 is an enlarged exploded perspective view of a portion of a disk arm including an anti-rotation structure for the seal strip assembly in accordance with an aspect of the present invention.

Referring to FIG. 3, the slots 52 and 54 are described with particular reference to the slot 52, it being understood that the slot 54 may be formed with the same configuration as slot 52. The slot 52 is defined by opposing outer and inner radially facing slot surfaces 66, 68, defining a predetermined sealing slot gap dimension G therebetween. The predetermined slot gap dimension G is sized with reference to a thickness dimension T of the sealing band 60, as measured between a radially outwardly facing surface 70 and an opposing radially inwardly facing surface 72 of the sealing band 60 (FIGS. 2 and 6). In particular, the slot gap dimension G and sealing band thickness dimension T are sized to provide a close fit between the sealing band 60 and the slots 52, 54 to prevent or substantially limit flow of gases around the sealing band edges 62, 64.

In accordance with an aspect of the invention, the seal strip assembly includes an anti-rotation structure for preventing movement of a segment of the sealing band 60 relative to other segments of the sealing band 60. It may be noted that for the present description, a segment of the sealing band 60 is referenced herein as the sealing band 60. However, a plurality of segments, such as four segments, may form the sealing band 60, and that a separate anti-rotation structure may be provided for each segment of the sealing band 60. For example, an anti-rotation structure may be provided at the mid-span of each of the sealing band segments.

Referring to FIGS. 2 and 3, the anti-rotation structure includes a through hole 74 extending from a radially outwardly facing side 76 of the disk arm 34 to the outer radially facing slot surface 66 of the slot 52, and additionally includes a pin member 78 configured to be received in the through hole 74. The through hole 74 is formed as a radially extending circular hole having a longitudinal hole axis 81, as defined by a circular wall 80. A pair of opposing lobe areas 82, 84 extend laterally outwardly from the circular wall 80. The lobe areas 82, 84 are defined by generally semi-circular walls 82*a*, 84*a* extending parallel to the longitudinal hole axis 81 from the radially outwardly facing side 76 of the disk arm 34 to the outer radially facing slot surface 66. A diameter of the lobe areas 82, 84 is substantially less than a diameter of the hole 74 defined by the circular wall 80.

Figure 4:
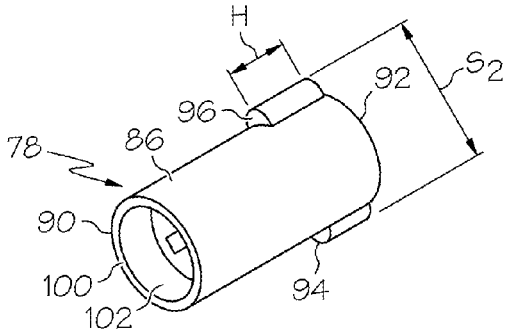
FIG. 4 is a perspective view of a pin member in accordance with an aspect of the present invention.

Referring to FIGS. 3 and 4, the pin member 78 is formed as a cylindrical structure defined by a cylindrical outer wall 86. The pin member 78 has a length dimension from a radially outer end 90 to a radially inner end 92 that is approximately equal to, or slightly less than, the radial distance from the radially outwardly facing side 76 of the disk arm 34 to the inner radially facing slot surface 68. A diameter of the pin member outer wall 86 is slightly less than the diameter of the hole 74, as defined by the circular wall 80, such that the pin member 78 may slide freely into the hole 74. For example, the diameter of the pin member 78 may be formed with about 0.1 mm clearance relative to the diameter of the hole 74.

The pin member 78 is formed with a pair of tabs 94, 96 extending from laterally opposing sides of the pin member 78 adjacent to the inner end 92. The tabs 94, 96 comprise generally semi-cylindrical structures elongated along the length of the outer wall 86 of the pin member 78 and define a height dimension H extending parallel to the length of the pin member 78. The height dimension H is slightly less than the slot gap dimension G. For example, the tabs 94, 96 may be formed such that the height dimension H is about 0.5 mm less than the slot gap dimension G, as will be discussed further below. Additionally, a dimension $S_1$ (see FIG. 5) spanning between the laterally outermost points on the lobe areas 82, 84 is greater than a dimension $S_2$ (see FIG. 4) spanning between the laterally outermost points on the tabs 94, 96 on the pin member 78, thereby facilitating the passage of the pin member 78 through the hole 74.

Figure 5:
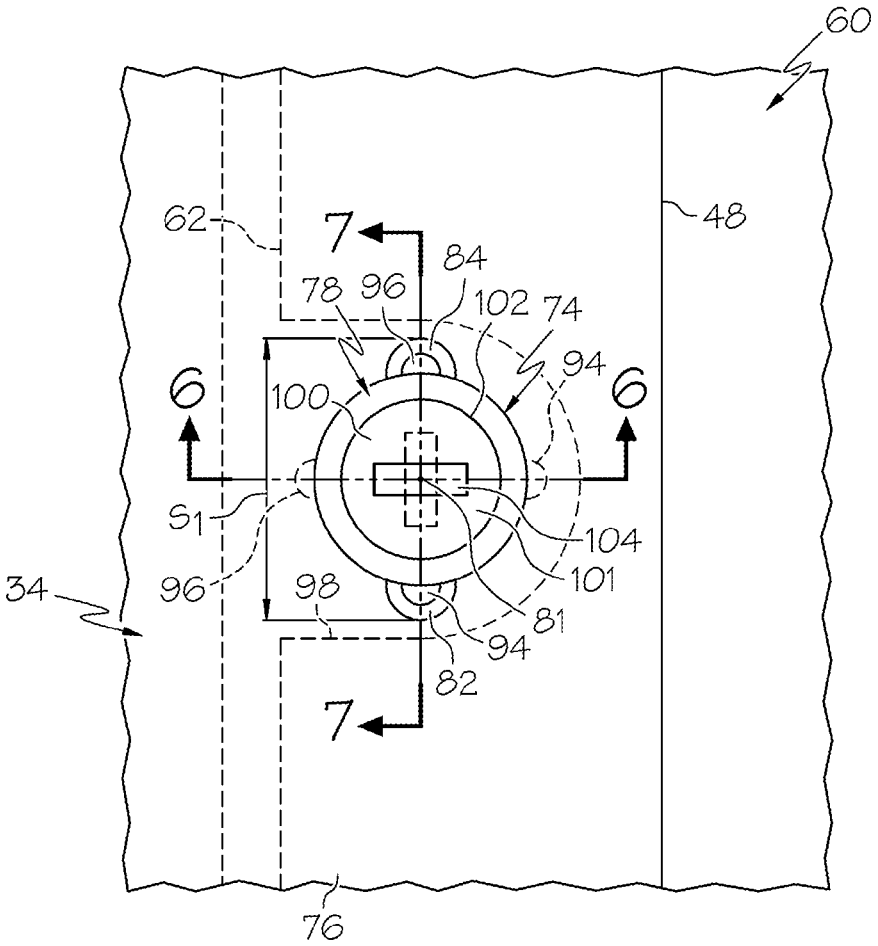
FIG. 5 is a plan view of a disk arm illustrating assembly of the anti-rotation structure on the disk arm.

In accordance with a further aspect of the invention, the sealing band 60 is formed with a notch 98 extending into the edge 62 of the sealing band 60, as seen in FIGS. 2 and 5. The notch 98 defines an opening for receiving the pin member 78 therein. In particular, in an assembly operation for the anti-rotation structure, the sealing band 60 is positioned within the slots 52, 54 spanning the annular gap 56 between the end faces 48, 50, as is shown in FIG. 6. The sealing band 60 is positioned such that the notch 98 is located in circumferential alignment with the hole 74, i.e., with axis 81 of the hole 74 extending radially generally centrally through the notch 98.

The pin member 78 is inserted through the hole 74 to position the inner end 92 adjacent to, e.g., engaging, the inner radially facing slot surface 68. As noted above, the outer wall 86 of the pin member 78 and the tabs 94, 96 are dimensioned to easily fit within the hole 74 and lobe areas 82, 84, respectively, such that the pin member 78 may slide through the hole 74 without interference.

The pin member 78 is then rotated to move the tabs 94, 96 to a position directly under the outer radially facing slot surface 66, such as by rotating the pin member about 90 degrees, as illustrated by the dotted lines 94, 96 in FIG. 5. The rotated position of the pin member 78, and location of the tabs 94, 96, is further seen in FIG. 6. As noted above, the height dimension H of the tabs 94, 96 is less than the gap dimension G, such that the tabs 94, 96 may be rotated within the area of the slot 52 without interference with the outer and inner radially facing slot surfaces 66, 68.

Referring to FIG. 6, the outer radially facing slot surface 66 forms an engagement feature extending laterally of the hole 74, and the tabs 94, 96 of the pin member 78 form a laterally extending cooperating feature positioned in engagement with the engagement feature of the slot surface 66. The engagement of the tabs 94, 96 with the outer radially facing slot surface 66 operates to radially retain the pin member 78 within the hole 74 and maintain the radially inner end 92 of the pin member 78 positioned within the notch 98 of the sealing band 60.

Referring to FIGS. 4-6, the radially outer end 90 of the pin member 78 is formed with a blind hole 100. In particular, the radially outer end 90 comprises a relatively thin circumferential wall 102 that defines the blind hole 100 extending axially into the pin member 78. Additionally, a slot 104 may be formed in the surface 101 forming the bottom of the blind hole 100 for engagement with a tool (not shown) to facilitate rotation of the pin member 78. It may be noted that the notch 98 in the sealing band 60 is sized such that the pin member 78 may be rotated within the notch 98 without interference with the surfaces defining the notch 98, as may be particularly seen in FIG. 5.

Figure 7:
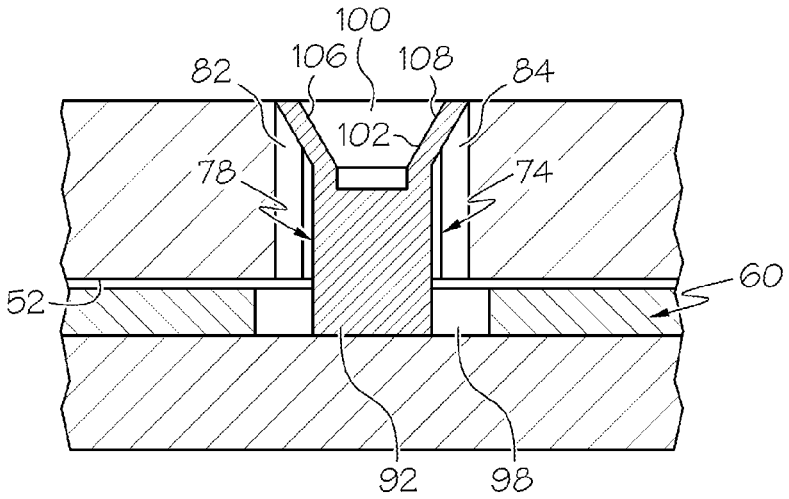
FIG. 7 is a cross-sectional view of the anti-rotation structure in an assembled state, as taken along line 7-7 in FIG. 5.

Referring to FIG. 7, subsequent to rotation of the pin member 78 to engage the tabs 94, 96 adjacent to the outer radially facing slot surface 66, portions of the circumferential wall 102 may be deformed outwardly into the lobe areas 82, 84 to prevent rotation of the pin member 78. Specifically, one or more outwardly deformed portions 106, 108 may formed, such as by a peening operation, to locate the deformed portions 106, 108 into a respective one or more of the lobe areas 82, 84 to prevent rotational movement of the pin member 78 and the tabs 94, 96 back into alignment with the lobe areas 82, 84. Hence, the pin member 78 is positively retained within the hole 74 subsequent to the deformation of the circumferential wall 102 during the installation operation, positioning the inner end 92 of the pin member 78 for engagement with the notch 98 in the sealing band 60 as an anti-rotation mechanism preventing or limiting movement of the sealing band 60 relative to the disk arms 34, 36.

Figure 8:
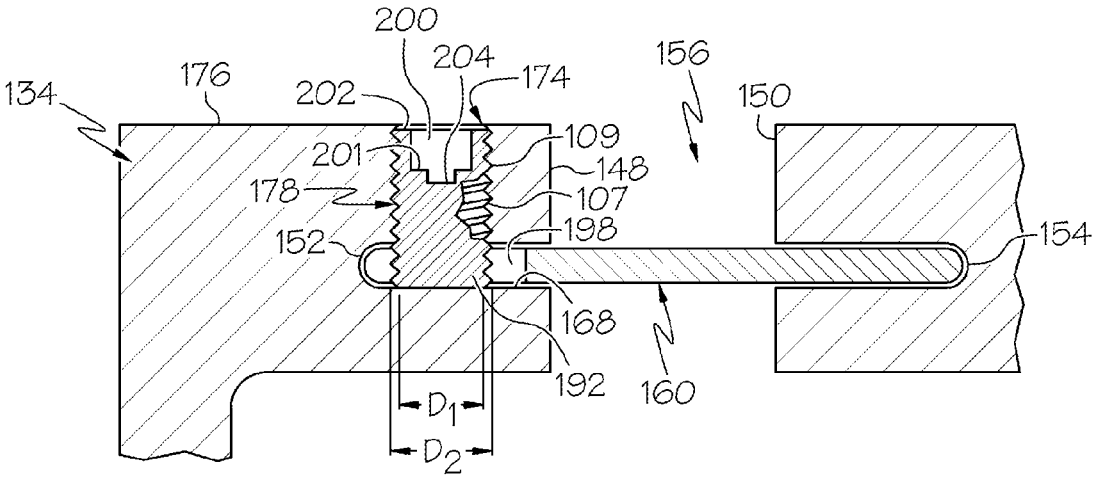
FIG. 8 is a view similar to FIG. 6 illustrating an alternative aspect of the present invention.

Referring to FIG. 8, an alternative configuration for the anti-rotation structure is described wherein elements corresponding to the elements described with reference to FIGS. 2-7 are labeled with the same reference numerals increased by 100.

In accordance with the aspect of the invention illustrated in FIG. 8, the structure of the disk arm slots 152, 154 and the sealing band 160 received therein is the same as described above for slots 52, 54 and sealing band 60. The disk arm 134 is formed with a through hole 174 for receiving a pin member 178. The through hole 174 is formed with an engagement feature comprising an internal screw thread 107 extending laterally from a minor dimension, generally depicted by dimension line $D_1$, to a major dimension, generally depicted by dimension line $D_2$. The internal screw thread 107 forms an engagement feature located laterally outwardly of the hole 174.

The pin member 178 is formed with a cooperating feature comprising an external screw thread 109 extending laterally outwardly from an outer dimension of the pin member 174, defined by a minor diameter that is generally depicted by the dimension line $D_1$. The external screw thread 109 extends outwardly to a major diameter that is generally depicted by the dimension line $D_2$. Although the dimensions of the internal screw thread 107 and external screw thread 109 are generally referenced to the same dimension lines $D_1$ and $D_2$, a small clearance is provided between the internal and external threads 107, 109, as is know the art for forming cooperating internal and external threads, for accommodating rotation of the pin member 178 within the hole 174.

The pin member 178 may also be formed with a blind hole 200 including a circumferential wall 202. Additionally, a slot 104 may be formed in a surface 201 forming the bottom of the blind hole 200 for engagement with a tool (not shown) to facilitate rotation of the pin member 178.

In an assembly operation for the anti-rotation structure of FIG. 8, the sealing band 160 is positioned within the slots 152, 154 spanning the annular gap 156 between the end faces 148, 150. The sealing band 160 is positioned such that the notch 198 is located in circumferential alignment with the hole 174.

The pin member 178 is inserted through the hole 174 by rotating the pin member 178 to engage the internal and external threads 107, 109. Threaded movement of the pin member 178 into the hole 174 positions the inner end 192 of the pin member 178 adjacent to, e.g., engaging, the inner radially facing slot surface 168.

It may be noted one or more lobe areas may be provided, located laterally outwardly from the hole 174, in a manner similar to the lobe areas 82, 84 illustrated in FIGS. 3, 5 and 6, however, the lobe area(s) may extend only partially along the radial extent of the hole 174 from the radially outwardly facing side 176 of the disk arm 134. The circumferential wall 202 may be deformed laterally outwardly into the one or more lobe areas, as described above for the pin member 78, to prevent rotation of the pin member 178 out of the hole 174 once the inner end 192 of the pin member 178 is positioned within the opening defined by the notch 198.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine comprising:

a plurality of stages, each stage comprising a rotatable disk and blades carried thereby, at least one pair of adjacent rotatable disks defining an annular gap therebetween and having respective opposing sealing band receiving slots aligned with the annular gap;

a sealing band located in the opposing sealing band receiving slots to seal the annular gap;

a through hole defined in at least one of said disks, said through hole defining a longitudinal hole axis and extending to said sealing band receiving slot in said at least one disk;

at least one engagement feature on said at least one disk extending laterally of said through hole, perpendicular to said longitudinal hole axis;

a pin member extending through said through hole and positioned within said sealing band receiving slot passing through an opening in said sealing band for resisting movement of said sealing band relative to said at least one disk, said pin member including a laterally extending cooperating feature positioned in engagement with said at least one engagement feature for retaining said pin member within said opening in said sealing band; and wherein said opening in said sealing band includes a notch formed in an edge of said sealing band, and said pin member includes a radially inner end located within said notch in said sealing band.

2. The turbine of claim 1, wherein said laterally extending cooperating feature comprises a pair of tabs extending from laterally opposing sides of said radially inner end of said pin member, and said at least one engagement feature including a surface within said sealing band receiving slot in said at least one of said disks, extending laterally from said through hole, perpendicular to said longitudinal hole axis, for engagement with said pair of tabs.

3. The turbine of claim 2, wherein said through hole includes a pair of opposing laterally extending lobe areas for permitting passage of said pair of tabs therethrough.

4. The turbine of claim 3, wherein said pin member includes a radially outer end, opposite said radially inner end, having outwardly deformed portions extending into said pair of opposing laterally extending lobe areas for preventing rotation of said pin member within said through hole.

5. The turbine of claim 1, wherein said at least one engagement feature and said laterally extending cooperating feature comprise threaded portions on said each of said through hole and said pin member, respectively.

6. The turbine of claim 1, wherein said pin member includes a radially outer end, opposite said radially inner end, and including a blind hole extending into said radially outer end.

7. The turbine of claim 6, wherein said through hole includes at least one laterally extending lobe area, and a circumferential wall defining said blind hole in said pin member defines at least one outwardly deformed portion extending into said at least one laterally extending lobe area for preventing rotation of said pin member within said through hole.

8. A turbine comprising:

a plurality of stages, each stage comprising a rotatable disk and blades carried thereby, each rotatable disk including a radially outwardly facing side, at least one pair of adjacent rotatable disks defining an annular gap therebetween and having respective opposing sealing band receiving slots aligned with the annular gap, said sealing band receiving slots each including opposing outer and inner radially facing slot surfaces;

a sealing band located in the opposing sealing band receiving slots to seal the annular gap;

a through hole defined in at least one of said disks, extending from said radially outwardly facing side through said outer radially facing slot surface, said through hole defining a longitudinal hole axis and extending through only an outer portion of said at least one of said disks from said radially outwardly facing side to one of said sealing band receiving slots in said at least one of said disks;

at least one engagement feature on said at least one of said disks extending laterally of said through hole, perpendicular to said longitudinal hole axis;

a pin member extending through said through hole and positioned through an opening in said sealing band, said pin member including a laterally extending cooperating feature positioned in engagement with said at least one engagement feature for preventing radial outward movement of said pin member out of said through hole and said pin member including a radially inner end located adjacent said inner radially facing slot surface of said one of said sealing band receiving slots;

wherein said at least one engagement feature is located radially outward of said one of said sealing band receiving slots.

9. The turbine of claim 8, wherein said laterally extending cooperating feature comprises a pair of tabs extending from laterally opposing sides of said radially inner end of said pin member, and said at least one engagement feature including a surface within said one of said sealing band receiving slots in said at least one of said disks, extending laterally from said through hole, perpendicular to said longitudinal hole axis, for engagement with said pair of tabs.

10. The turbine of claim 9, wherein said at least one engagement feature for engaging said pair of tabs is defined by said outer radially facing slot surface.

11. The turbine of claim 9, wherein said through hole includes a pair of opposing laterally extending lobe areas for permitting passage of said pair of tabs therethrough.

12. The turbine of claim 11, wherein said pair of opposing laterally extending lobe areas comprise generally semi-circular areas extending laterally outwardly from a wall defining said through hole.

13. The turbine of claim 11, wherein said pin member includes a radially outer end, opposite said radially inner end, having outwardly deformed portions extending into said pair of opposing laterally extending lobe areas for preventing rotation of said pin member within said through hole.

14. The turbine of claim 8, wherein rotation of said pin member about said longitudinal hole axis positions said laterally extending cooperating feature into engagement with said at least one engagement feature.

15. The turbine of claim 14, wherein said at least one engagement feature is defined by a screw thread and said laterally extending cooperating feature is defined by a screw thread engaged with said screw thread of said at least one engagement feature.

16. The turbine of claim 8, wherein said pin member includes a radially outer end, opposite said radially inner end, and including a blind hole extending into said radially outer end.

17. The turbine of claim 16, wherein said through hole includes at least one laterally extending lobe area, and a circumferential wall defining said blind hole in said pin member defines at least one outwardly deformed portion extending into said at least one laterally extending lobe area for preventing rotation of said pin member within said through hole.

18. The turbine of claim 16, including a slot formed in a bottom surface of the blind hole for engagement with a tool to rotate the pin member within the through hole.

19. A turbine comprising:

a plurality of stages, each stage comprising a rotatable disk and blades carried thereby, each rotatable disk including a radially outwardly facing side, at least one pair of adjacent rotatable disks defining an annular gap therebetween and having respective opposing sealing band receiving slots aligned with the annular gap, said sealing band receiving slots each including opposing outer and inner radially facing slot surfaces;

a sealing band located in the opposing sealing band receiving slots to seal the annular gap;

a through hole defined in at least one of said disks, extending from said radially outwardly facing side through said outer radially facing slot surface, said through hole defining a longitudinal hole axis and extending to one of said sealing band receiving slots in at least one of said disks;

at least one engagement feature on said at least one of said disks extending laterally of said through hole, perpendicular to said longitudinal hole axis;

a pin member extending through said through hole and positioned through an opening in said sealing band, said pin member including a laterally extending cooperating feature positioned in engagement with said at least one engagement feature for preventing radial movement of said pin member out of said through hole; and wherein said laterally extending cooperating feature comprises a pair of tabs extending from laterally opposing sides of a radially inner end of said pin member, said pair of tabs defining radially facing surfaces for engagement with said at least one engagement feature, and said at least one engagement feature including a surface within said one of said sealing band receiving slots defined by said outer radially facing slot surface in said at least one of said disks, extending laterally from said through hole, perpendicular to said longitudinal hole axis, for engagement with said radially facing surfaces of said pair of tabs.

* * * * *